US006698261B2

(12) United States Patent
Trempala

(10) Patent No.: US 6,698,261 B2
(45) Date of Patent: Mar. 2, 2004

(54) LOCKING CAP SYSTEM

(75) Inventor: Dohn J. Trempala, Corona del Mar, CA (US)

(73) Assignee: Knox Company, Irvine, CA (US)

( * ) Notice: Subject to any disclaimer, the term of this patent is extended or adjusted under 35 U.S.C. 154(b) by 0 days.

(21) Appl. No.: 10/273,894

(22) Filed: Oct. 17, 2002

(65) Prior Publication Data

US 2003/0033840 A1 Feb. 20, 2003

Related U.S. Application Data

(63) Continuation of application No. 09/247,665, filed on Feb. 9, 1999, now Pat. No. 6,487,882.

(60) Provisional application No. 60/074,156, filed on Feb. 9, 1998.

(51) Int. Cl.[7] ..... B65D 55/14

(52) U.S. Cl. ..... 70/169; 403/370; 403/371; 137/296; 81/471

(58) Field of Search ..... 70/163, 166–169, 70/175–179, 229, 230, 232, 244, 416, 417, DIG. 57; 403/370, 371; 137/294, 296, 68, 14, 272, 304–306, 377, 382, 383, 384.2; 81/471, 125.1, 124.3–124.5, 124.7

(56) References Cited

U.S. PATENT DOCUMENTS

| | | | | |
|---|---|---|---|---|
| 703,016 | A | 6/1902 | Tash | 70/169 |
| 737,667 | A | 9/1903 | Schunck | 70/168 X |
| 1,349,610 | A | 8/1920 | Gibney | 70/168 |
| 2,283,371 | A | 5/1942 | Johnson | 70/168 |
| 2,463,138 | A | 3/1949 | Bamberg | 287/124 |
| 2,777,353 | A | 1/1957 | Willis | 85/45 |
| D192,653 | S | 4/1962 | Madeira | D54/16 |
| 3,136,148 | A | 6/1964 | Nehls | 70/169 |
| D206,455 | S | 12/1966 | Thompson | D49/1 |
| 3,361,460 | A | 1/1968 | Jansen | 403/370 X |
| 3,695,139 | A | 10/1972 | Howe | 52/707 |
| 3,738,691 | A | 6/1973 | Firth | 403/370 |
| 3,855,882 | A | 12/1974 | Wittmann | 81/121 R |
| 3,914,966 | A | 10/1975 | Bello | 70/163 |
| 3,915,335 | A | 10/1975 | Shanklin et al. | 70/169 X |
| 4,022,536 | A | 5/1977 | Piepho et al. | 403/371 X |
| 4,140,413 | A | 2/1979 | Conrad | 403/370 |
| 4,141,574 | A | 2/1979 | Stansifer et al. | 137/296 X |
| 4,172,606 | A | 10/1979 | Howe | 285/34 |
| 4,182,361 | A | 1/1980 | Oakey | 137/296 |
| 4,184,516 | A | 1/1980 | Oesterritter et al. | 138/96 X |
| 4,351,446 | A | 9/1982 | Madden | 70/168 X |
| 4,526,193 | A | 7/1985 | Drach | 137/296 |
| 4,527,407 | A | 7/1985 | Shanklin | 70/169 X |
| 4,566,481 | A | 1/1986 | Leopold, Jr. et al. | 137/296 |
| 4,633,896 | A | 1/1987 | Bainbridge et al. | 137/296 |
| 4,651,771 | A | 3/1987 | Borenstein et al. | 137/296 |
| 4,674,306 | A | 6/1987 | Halpern | 70/167 X |
| 5,033,501 | A | 7/1991 | Stehling | 137/296 |
| 5,072,750 | A | 12/1991 | Poms et al. | 137/296 |
| 5,295,831 | A | 3/1994 | Patterson et al. | 81/471 X |
| 5,383,495 | A | 1/1995 | Kennedy | 137/296 X |
| 5,419,650 | A | 5/1995 | Hoshino | 403/371 X |
| 5,462,381 | A | 10/1995 | DeWachter et al. | 403/371 X |

(List continued on next page.)

*Primary Examiner*—Suzanne Dino Barrett
(74) *Attorney, Agent, or Firm*—Knobbe, Martens, Olson & Bear, LLP

(57) ABSTRACT

A locking cap is selectively locked into place within a tubular opening, such as the open end of a standpipe used to charge a building sprinkler system. The locking cap has an expandable sleeve and a spreader member. As a key is turned, the spreader member is drawn into the expandable sleeve which is urged outward. The outward movement of the expandable sleeve increases a frictional component such that the expandable sleeve becomes frictionally locked within the tubular opening. The key has an end design that is complemented by an end of an actuator shaft such that the likelihood of unauthorized removal of the locking cap is reduced.

13 Claims, 5 Drawing Sheets

U.S. PATENT DOCUMENTS

| | | | | |
|---|---|---|---|---|
| 5,549,133 | A | 8/1996 | Sigelakis | 137/296 |
| 5,588,460 | A | 12/1996 | Meneses | 137/296 |
| 5,632,301 | A | 5/1997 | Julicher | 137/296 |
| 5,803,110 | A | 9/1998 | Segal | 137/68.14 |
| D400,769 | S | 11/1998 | Duke | D8/21 |
| 5,868,047 | A | 2/1999 | Faust et al. | 81/471 X |
| 5,904,057 | A | 5/1999 | Abney, III et al. | 70/167 |
| 6,070,442 | A | 6/2000 | Neeley et al. | 70/175 |
| 6,487,882 | B2 * | 12/2002 | Trempala | 70/169 |

* cited by examiner

LOCKING CAP SYSTEM

CROSS REFERENCE TO RELATED APPLICATION

This application is a continuation of U.S. application Ser. No. 09/247,665, filed on Feb. 9, 1999 now U.S. Pat. No. 6,487,882 which claims priority from U.S. Provisional Application No. 60/074,156, filed on Feb. 9, 1998.

BACKGROUND OF THE INVENTION

1. Field of the Invention

The present invention generally relates to a locking cap and key combination for open ends of plumbing components and, more specifically, to a protective locking cap and key combination for threaded openings in couplings, fixtures and the like. Even more specifically, the present invention relates to a locking cap and key combination for fire retardant sprinkler systems utilizing charging pipes.

2. Description of the Related Art

In fire protection systems that include automatic sprinkler systems having multiple sprinkler heads, the standing water supply is often not sufficient to maintain optimum operating water pressure when there are several sprinkler heads in simultaneous operation. Accordingly, the National Fire Protection Association Code requires a connection through which a fire department can pump water into the sprinkler system in order to charge or recharge the sprinkler system. Where such connections are provided, upon arrival of fire department personnel, an auxiliary source of water supply, usually a hose supplied with water from a fire truck pump, may be connected to a union connection advantageously located outside the building. Such hose connections are often termed siamese connections and are fitted with union nuts having an internal thread sized and configured to match the external thread of the hose of the local fire department. Also, in most instances, the union nut is loosely retained on the inlet pipe through a bearing arrangement and is provided with radially extending parts adapted to be operated by a "spanner" wrench carried by most firefighters.

The National Fire Protection Association Code also specifies that such hose connections shall be equipped with plugs or caps. Because the hose connections are in public locations which may be unsecured, the plugs or caps are desired to reduce the likelihood that passersby, vandals, or arsonists will damage the connections and render the connections inoperable. Thus, the plugs or caps cover the auxiliary water inlet to the sprinkler system to prevent malicious introduction of trash or other debris. Such trash and debris might clog the sprinkler system when it is needed most.

Several types of caps or plugs have heretofore been provided to cover the union nut of siamese connections and protect the integrity and operability of the sprinkler system. One such arrangement includes an easily breakable cap, made of cast iron for example, which cap is attached to the union nut by U-bolts carried by the cap but adapted to engage the posts of the union nut to hold the cap in place. Such cap members have been particularly vulnerable to vandalism and are particularly susceptible to breakage at the points where the U-bolts are received in the cap. Furthermore, even where the cap is not broken, certain portions of the cap rust through over time and the caps simply fall off. In addition, because of the differences in coefficients of thermal expansion between the union nut and the cap, the cap is also susceptible to breakage.

Another common device is a brass plug having external threads to be received in the union nut where the plug, like the union nut, is provided with radially extending posts to be operated by a spanner wrench. The union nut of such siamese connections is usually brass so it is necessary to provide brass plugs, which are of substantial scrap value. Accordingly, because of their location in often unsecured public places, the plugs are frequently stolen for resale as scrap.

SUMMARY OF THE INVENTION

Accordingly, a locking cap is desired for a standpipe that can be securely mounted so that it is not easily removed by unauthorized personnel. Additionally, such a locking cap desirably is quickly removed by authorized personnel under time pressures and mental anxiety. Moreover, such a locking cap should be relatively impervious to climatic elements such that deterioration over time is reduced.

Thus, the present invention provides a locking cap and key combination that is virtually tamperproof such that it cannot be removed without substantial destruction thereof, but which is not susceptible to inadvertent breakage. Moreover, the locking cap is easily removed at the appropriate time by authorized personnel utilizing a specially designed mating key arrangement. Furthermore, another aspect of the present invention provides a straightforward cap design which is easily and economically fabricated, and which is easily attached to secure a fire sprinkler system.

One feature of the present invention is the universal nature of the key and locking cap. While it is advantageous to prevent vandals and the like from removing the locking cap, the locking caps are configured with a unique locking mechanism which allows the fire department, or other authorized personnel, to use a single key to unlock every locking cap within their jurisdiction. This capability may prove important during crisis situations requiring rapid response. Specifically, the use of a single key eliminates the need to rifle through a variety of keys to find the proper key to remove the subject locking cap. Additionally, the locking caps may be serialized to empower a fire department or other entity with an ability track their location in the event of a lost, stolen or otherwise transferred locking cap.

One aspect of the present invention involves a locking cap for a pipe end. The locking cap has a faceplate and a plug portion. The faceplate has a front surface and a rear surface while the plug portion has a front surface, a rear surface and a side surface. A slot extends longitudinally between the front surface and the rear surface and radially between the side surface and a relief opening. Additionally, a channel is defined along the slot proximate the side surface. The plug portion is connected to the faceplate with the rear surface of the faceplate arranged to substantially face the front surface of the plug portion. Moreover, the plug portion is sized and configured to be received by the pipe end. The channel receives a translatable spreader member wherein at least one surface of the spreader member or the channel is tapered such that the spreader member and the channel cooperate to expand and retract the plug portion.

Another aspect of the present invention involves a locking cap for a tubular opening. The locking cap generally comprises a cap body having an expansion member and a spreader member. The expansion member and the spreader member include a sloping engagement face such that relative axial movement of the expansion member and the spreader member results in radial displacement of at least a portion of the expansion member. The radial displacement of the portion of the expansion member urges the expansion member into a frictional interlock with an inner surface of the opening.

Yet another aspect of the present invention involves a locking cap for a pipe end generally comprising a faceplate. The faceplate includes a front surface and at least two pins projecting from the front surface. The faceplate also has a back surface and is connected to a plug portion such that the back surface of the faceplate is proximate a surface of the plug portion. At least a portion of the plug portion is capable of selective expansion and contraction to create a frictional interlock between the locking cap and the pipe end.

Another aspect of the present invention involves a lockable closure for an open end of a tubular element. The closure generally comprises a radially expanding member and an actuator shaft. The actuator shaft has a first end and a second end with the first end of the actuator shaft having a keyed configuration. The second end of the shaft extends through the closure into the tubular element. The actuator shaft is rotatable relative to the closure and is connected to the radially expanding member such that rotation of the actuator shaft in one direction effects generally outward movement of the radially expanding member and rotation of the actuator shaft in the other direction effects generally inward movement of the radially expanding member.

BRIEF DESCRIPTION OF THE DRAWINGS

These and other features, aspects and advantages will now be described with reference to drawings of a particular preferred embodiment which is intended to illustrate and not to limit the present invention and in which.

DETAILED DESCRIPTION OF THE PREFERRED EMBODIMENT

Figure 1:
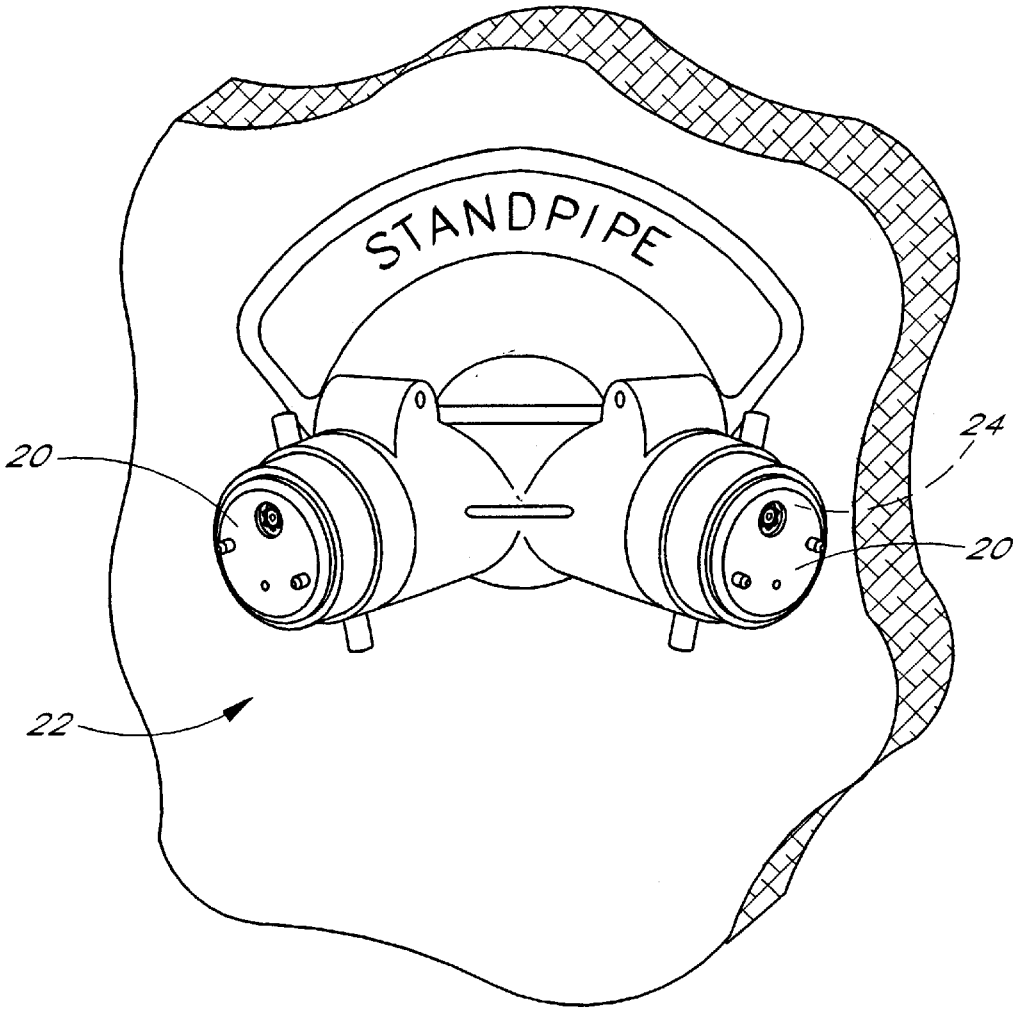
FIG. 1 is a perspective illustration of an exemplary standpipe connection having locking caps configured according to certain aspects of the present invention and having standard over caps hanging by chains from the standpipe connection.

With reference initially to FIG. 1, a locking cap 20 is illustrated in engagement with a standard standpipe 22 connection. The pipe ends have internal threads for attaching fire hoses or the like. The illustrated locking caps are secured within the pipe end in engagement with the internal threads of the pipe ends and may be covered by the standard caps if desired. However, the illustrated locking caps preferably replace the standard caps. The illustrated standpipe 22 provides an exemplary environment for the locking cap and key combination having certain features, aspects and advantages in accordance with the present invention. Specifically, the present locking cap and key combination is designed to protect fire sprinkler system standpipe openings 24, or other similar openings, from debris which may be maliciously inserted into the openings and which may then damage or plug the associated sprinkler system when the system is charged during use.

It is understood, however, that a locking cap and key combination having features, aspects and advantages in accordance with the present invention may also find utility in a variety of other contexts. For instance, but without limitation, the locking cap 20 may protect valves, pipes, connections, fittings and various other components having an open end subject to tampering or unauthorized access. Such components may be used in industries such as, for example but without limitation, those related to petrochemicals, chemicals, pharmaceuticals, and food or dairy processing. For instance, a locking cap may provide a way of securing an open pipe end in a petroleum line that may reduce or eliminate unauthorized access to such an opening 24.

With continued reference to FIG. 1, in use, the locking cap 20 is inserted into an open end 24 of a pipe, valve, connection, fitting or other similar component. In some embodiments, the locking cap 20 may be slid into place or it may be rotated into place via threads. Notably, as will be discussed below, the locking cap 20 configured in accordance with various aspects of the present invention may either fit over or within the opening 24. Once in place, a key 26 (see FIG. 3A) is used to lock the locking cap 20 in position. Various locking mechanisms may be used; however, a presently preferred expanding axial friction interlock will be described in detail below. When access to the opening 24 is desired or required, the key 26 may be used to quickly unlock the locking cap 20 and the locking cap 20 may then be easily removed. However, when the locking cap 20 is locked in place, the locking cap 20 resists removal and thereby protects the opening 24 from malicious debris insertion or accidental leaks while also protecting the locking cap 20 from theft or vandalism.

With continued reference to FIG. 1, the illustrated locking cap 20 provides a selectively lockable closure for the opening 24 of an end of a pipe. As will be discussed in detail below, the associated key 26 may be custom manufactured in a nonstandard pattern, may be purchased from commercial suppliers such as McGuard, or may simply be a standard tool, such as, for example but without limitation, an allen wrench, a square socket or the like. The illustrated key 26 is designed for use with a lock actuator bolt 28, which is described in detail below and may be manufactured by suppliers such as McGuard. Thus, the key 26 and the lock actuator bolt 28 are desirably formed as a matching lug and socket combination.

Figure 3A:
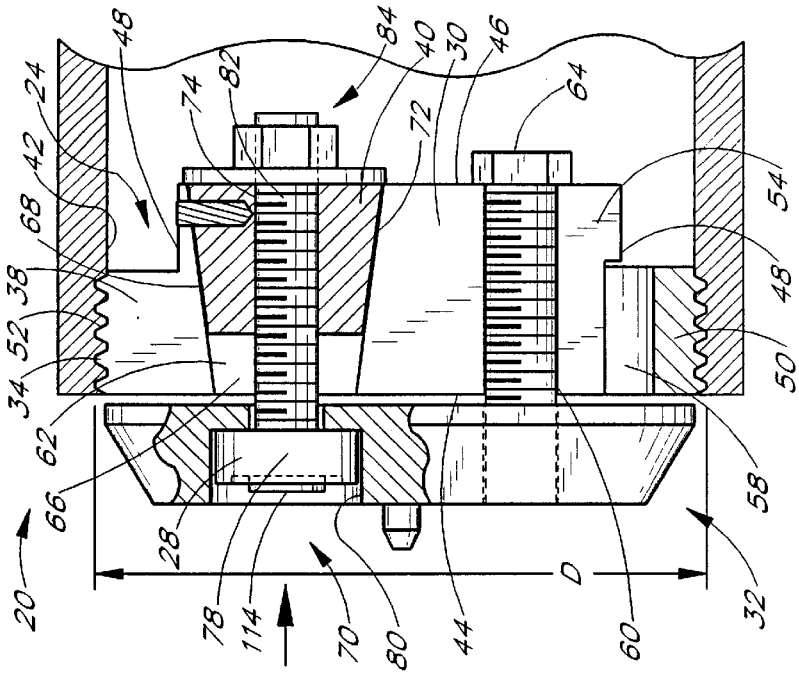
FIG. 3A is a partially sectioned side view of a locking cap and key combination having features, aspects and advantages in accordance with the present invention, with the locking cap inserted within a pipe but not locked therein.

With reference to FIG. 3A, the illustrated locking cap 20 generally comprises a plug portion 30 and a faceplate 32. While the plug portion 30 of the illustrated locking cap 20 is sized and configured for insertion into the pipe end opening 24 or other similar opening, it is envisioned that certain aspects of the present invention may also be used with externally positioned caps, as will be described more fully below. Additionally, while the illustrated plug portion 30 desirably has external threads 34 along a portion thereof, other non-threaded configurations may also have features in accordance with the present invention. Accordingly, as used herein, the term "cap" includes both a covering cap and an insertion plug. Additionally, an "opening" of an environmental structure shall mean the open end of a pipe, connection, valve, fitting and the like.

Figure 2:
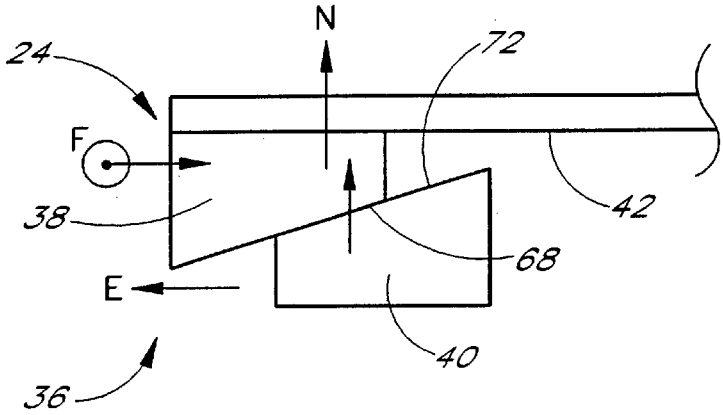
FIG. 2 is a schematic illustration of a frictional interlock having features, aspects and advantages in accordance with the present invention.

With reference now to the schematic illustration of FIG. 2, a locking mechanism 36 having features, aspects and advantages in accordance with the present invention will now be introduced and described. The illustrated locking arrangement generally comprises an expansion member 38 and a spreader member 40. The expansion member 38 and the spreader member 40 cooperate to selectively urge the expansion member 38 outward into abutment with an inner wall 42 of an opening 24. While the illustrated expansion member 38 is positioned closer to the pipe end, it is anticipated that the relative positions of the two members 38, 40 may also be reversed in some embodiments. As the spreader member 40 slides relative to the expansion member 38, the expansion member 38 either moves outward or inward. Specifically, the expansion member 38 is moved outward from a nonbiased position by an extending movement E of the spreader member and held in the outward position by the spreader member. The expansion member 38, therefore, springs back inward as the spreader member 40 retreats during its retracting movement. When the expansion member 38 is moved outward, a normal force N between the expansion member 38 and the inner wall 42 of the opening 24 increases. The increasing normal force N results in an increasing frictional force F that will tend to oppose rotational movement of the locking cap 20 relative to the opening 24 as well as tending to opposing sliding movement of the locking cap 20. Thus, the locking cap 20 may be locked into place within the opening 24 and the locking cap 20 may not be easily removed therefrom without first reducing the normal force N.

As will be appreciated, a similar structure may also be configured for use on the exterior of an pipe or the like which might allow a cap to be placed over the outside of the pipe or the like. Additionally, as will be described below in greater detail, the expansion member 38 of the illustrated embodiment is substantially coextensive with a circumference of the inner surface of the opening 24 in which the locking cap 20 is positioned; however, it is anticipated that single or multiple fingers may also perform the locking function through individual or discreet contact positions.

With reference again to FIGS. 3A and 4, the expansion member 38 of the illustrated locking cap 20 will now be described in detail. As will be recognized by those of skill in the art, the expansion member 38 may have many shapes and configurations. For instance, the expansion member 38 may be conical, rectangular, spherical, hemispherical or tubular in nature. However, in the presently preferred embodiment, the expansion member 38 is cylindrical. The cylindrical configuration advantageously increases the contact surface area between the expansion member 38 and the inner surface 42 of the opening 24 as compared to most other configurations. Specifically, as the expansion member 38 is displaced outward into contact with the inner surface 42 of the opening 24, the contact surface area is increased due to the arcuate exterior surface defined by the cylindrical configuration.

The expansion member 38 may be formed of any suitable material utilizing any number of well known machining techniques, including but not limited to milling, drilling, turning and the like. Additionally, the expansion member 38 may be forged, molded, or cast depending upon the characteristics of the material selected for use in the expansion member 38. The selection of the material used desirably accounts for the material properties and attempts to reduce galvanic corrosion. As will be recognized, the material selected for use may be a high strength polymer or metal, for instance. It is understood that galvanic corrosion in metal-on-metal contacts may be reduced by the use of a protective metal coating, such as zinc, tin, lead, nickel, or copper, by producing a coating of oxide, phosphate, or a similar coating on any iron and/or steel surfaces, or by utilizing protective paints to render the metal surface passive. In the presently preferred embodiment, the expansion member 38 is made from a slug of brass because it will form a plug for a brass standpipe 22. The selection of this material advantageously avoids the harmful composite side-by-side relationship of two differing metals that often may result in galvanic corrosion.

With reference again to FIGS. 3A and 4, the expansion member 38 generally has a front surface 44, a rear surface 46 (see FIG. 4), and a side surface 48 extending substantially longitudinally between the front surface 44 and the rear surface 46. The expansion member 38 may be sized and configured for easy insertion into the opening 24 that is to be capped. In one embodiment, the expansion member 38 has a major outside diameter D that is advantageously smaller than the inner diameter of the opening 24 into which it is inserted. This allows the expansion member 38 to be slid into place rather than requiring the expansion member 38 to be threaded into place. For applications such as fire standpipes, the major outside diameter D may range from about 1 inch to about 5 inches. Preferably, the major outside diameter D ranges from about 1.375 inches to about 3.25 inches. Even more preferably, the outside diameter is expandable from between about 2.90 inches to about 3.25 inches when the present locking cap is sized and configured for an ordinary fire standpipe. One of ordinary skill in the art will readily recognize that the ranges may be varied depending upon the application and also depending on the degree of initial interaction desired between the locking cap and the opening.

The side surface 48 may be stepped or straight. In the illustrated embodiment, the side surface 48 is stepped and has a larger-diameter portion 50 which extends rearward from the front surface 44 between about 0.5 inches and about 1.0 inches. As introduced above, the larger-diameter portion 50 preferably has external threads 34 that mate with threads 52 of the opening 24. As is known, the threads 34, 52 may be of any suitable size and configuration. For instance, when used with fire department standpipes, the threads would be configured according to the local fire department's specifications. Additionally, as is known, at least three threaded turns are desired; however, any number of threads 34 acceptable for the specific application may be provided on the locking cap 20. Moreover, dependent upon the application, more than one set of threads may also be used. For instance, two half turn threads may provide about the same holding force as a single thread but will require only a half turn to remove the locking cap.

With continued reference to FIG. 3A, the larger-diameter portion 50 is forward of a stepped down portion 54 that is preferably formed between the larger-diameter portion 50 and the rear surface 46. The stepped down portion 54 allows the overall thickness of the expansion member 38, or the plug portion 30, to be increased while reducing the likelihood that the locking cap 20 may damage the fitting into which it is inserted. Specifically, a hose coupling, with which the present cap has specific utility, generally has a union nut with an inner bearing race (not shown) that may be damaged if the locking cap 20 exerts sufficient pressure against an inner lip (not shown) of the union nut which is associated with the bearing race. Accordingly, the larger portion 50 and the stepped down portion 54 are desirably dimensioned to allow the locking cap 20 to be fully tightened into position without harming the hose coupling. In one embodiment, the overall length (i.e., the combined length of the larger portion and the stepped down portion) is between about 1.0 inch and about 1.5 inches. More preferably, the overall length is about 1.375 inches.

Significantly, the threads 34 are preferably matched to the internal threads 52 of the opening 24. Such a configuration reinforces the internal threads 52 of the opening 24 such that the threads 52 are less likely to be deformed or damaged when the locking cap 20 is locked into position. Additionally, when the illustrated locking cap 20 is locked into place, the opening 24 is reinforced and internally supported by the material forming the locking cap 20 such that the opening 24 is unlikely to be deformed if dealt blows by a pipe wrench or the like. Moreover, the intermeshed threads 34, 52 maintain the threads 34 of the opening 24 substantially clear once the locking cap 20 is removed such that the opening is maintained in better working condition (i.e., less corrosion and debris as compared to standard or missing caps or covers).

Figure 3B:
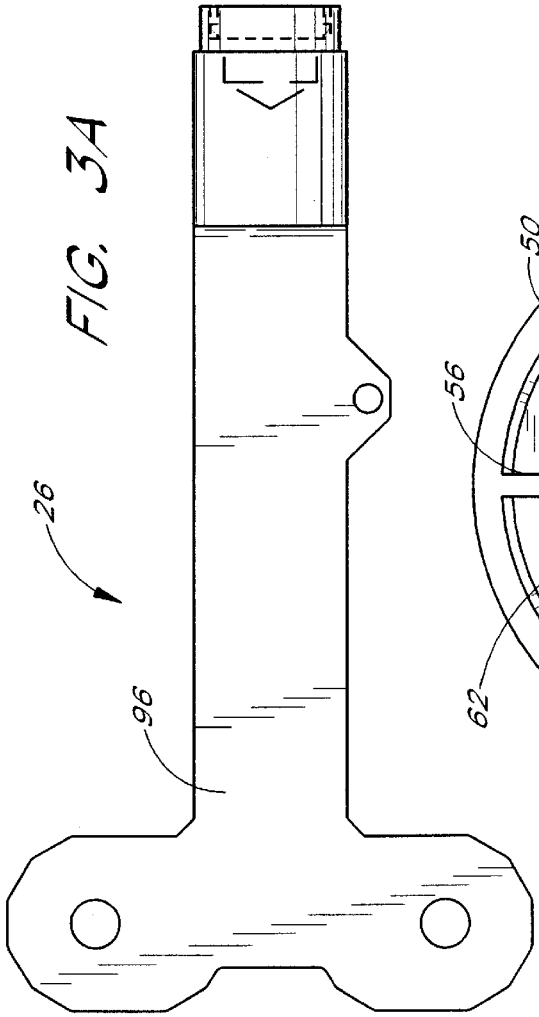
FIG. 3B is a rear view of the locking cap of FIG. 3A illustrating an interstitial slot and a relief slot.

As illustrated in FIG. 3B, the expansion member 38 has a longitudinally extending interstitial slot 56 extending partially across its diameter. The interstitial slot 56 may be arranged to extend through a longitudinal axis of the expansion member 38 or may be offset to either side.

The end of the interstitial slot 56 terminating within the expansion member 38 is joined to an aperture 58 which also extends through the expansion member 38 in a longitudinal direction. The aperture 58 is considered a relief aperture because it allows the material of the expansion member 38 to flex without exceeding its elastic limit. For instance, the expansion member 38 preferably provides hard sides which are hinged outward in an elastic deformation of the expansion member and are wedged against the sides of the pipe into which the locking cap is inserted. Due to the elastic springing action of the plug portion's expansion member and its hard side surfaces, the expanded plug portion provides an advantageously non-deforming locking element. Accordingly, the amount of material removed by the relief aperture 58 or the overall size of the relief aperture 58 is partially dependent upon the modulus of the material selected for the expansion member 38. Additionally, the relief aperture 58 is advantageously arcuate in shape (i.e., similar to a slot) to better distribute bending stresses throughout the material of the expansion member 38. The illustrated relief aperture or opening 58 comprises three holes having overlapping edges; however, a variety of other configurations (i.e., smooth milled slot, hole, etc.) may also be used.

Figure 4:
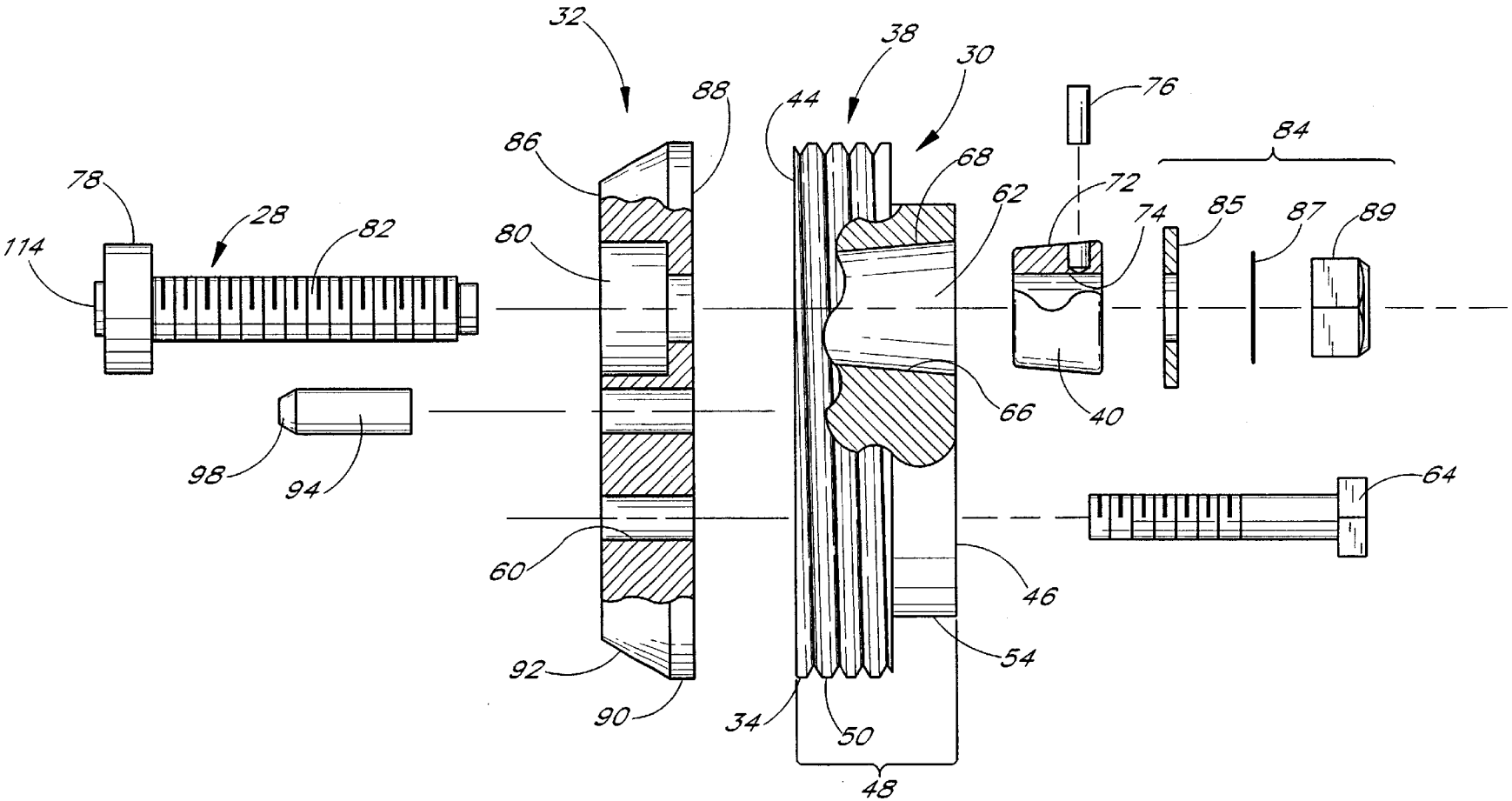
FIG. 4 is a partially sectioned exploded side view of the locking cap and key combination of FIG. 3A.

As best illustrated in FIG. 4, the expansion member 38 also comprises a pair of holes 60, 62. The first hole 60 is used with a threaded fastener 64 to connect the expansion member 38 to the faceplate 32. As will be recognized by those of skill in the art, the first hole 60 may be arranged substantially anywhere within the expansion member 38 which allows the threaded fastener 64 to pass therethrough and fasten the face plate 32 to the expansion member 38. The hole 60 may then be filled with epoxy to seal the forward portion of the hole for protection from the elements and tampering. Moreover, if the faceplate 32 is attached to the expansion member 38 is another manner (i.e. welded in a manner that still allows the expansion member 38 to flex) the first hole 60 may be removed.

The second hole 62, however, provides a channel 66 in which the spreader member 40 translates. The second hole 62 is positioned along the interstitial slot 56. As will be recognized by those of skill in the art, the closer to the side surface 48 (i.e., the circumference) that the second hole 62 is positioned along the interstitial slot 56, the less leverage is required to spread the expansion member 38. However, as will also be recognized, a sufficient thickness of material should remain between the second hole 62 and the side surface 48 to reduce the likelihood of failure through the side surface 48. The maximum diameter of the second hole 62 desirably ranges from about 0.5 inch to about 0.75 inch.

The second hole 62, because it provides a spreader member channel 66, may have a tapered surface 68 extending in either longitudinal direction. It should be appreciated, however, that a tapered spreader member 40 could travel into a non-tapered channel and achieve a similar effect or vice versa. In other words, the wide end of the second hole 62 can be arranged at either the front surface 44 or the rear surface 46 of the expansion member 38. However, the arrangement of the components preferably results in a loosening counterclockwise rotation of the actuator bolt 28 and a tightening clockwise rotation of the actuator bolt 28 such that the locking cap substantially conforms to standardized fastening arrangements. In the illustrated embodiment, the channel 66 tapers from a rear diameter of about 0.75 inch to a forward diameter of about 0.40 inch. These dimensions are illustrative only and may vary depending upon the application and materials selected. The taper is desirably configured to allow the necessary outward expansion with the amount of travel provided for the spreader member 40. In other words, the taper desirably allows the necessary expansion of the expansion member 38 when the spreader member 40 passes from a first position to a second position within the channel 66.

Figure 3B:
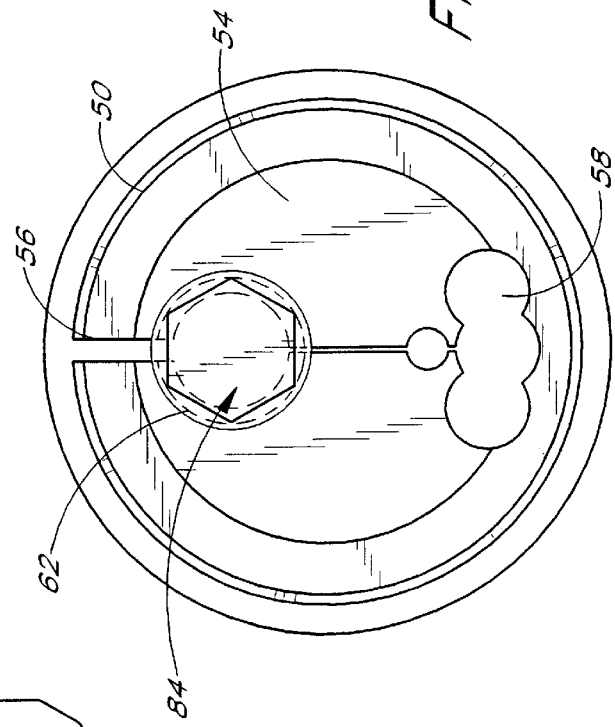

With continued reference now to FIG. 3, a spreader member 40 and an actuator mechanism 70 will now be described in detail. As described above, the spreader member 40 translates within the channel 66 under the control of the actuator mechanism 70 to effect expansion and contraction of the expansion member 38. This controlled translation affords positive control of the expansion and contraction of the expansion member 38. Accordingly, preferred materials for the spreader member 40 generally include such materials which will not substantially gall or corrode within the channel 66. Accordingly, the presently preferred material for the spreader member 40 is a hard, polished metal. For instance, the material may be a case hardened steel having a cadmium coating to reduce galvanic corrosion. Specifically, the steel may be case hardened by carborizing and then may be baked with a Cad II type coating.

The spreader member 40 advantageously has a tapered or sloping surface 72, or a flat surface that cooperates with the tapered or sloping surface 68 of the channel 66. As described above, the interacting surfaces 68, 72 result in the expansion or contraction of the expansion member 38 about the interstitial slot 56 when the bolt 28 is rotated. The presently preferred spreader member 40 is frusta conical (i.e., the base portion of a cone). As such, the frusta-conical spreader member 40 may be drawn through the tapered spreader member channel 66 defined by the second hole 62 to open the expansion member 38. As explained above, the inclination angles of both the second hole 62 and the spreader member 40 are partially dependent upon the amount of expansion desired and the length of the second hole 62 (which may be, in turn, dependent upon the overall length of the plug portion 30 or expansion member 38). In the illustrated embodiment, the inclination angle of the spreader member 40 is about 5 degrees from perpendicular to its base.

The illustrated spreader member 40 is moved along the spreader member channel 66 by the actuator mechanism 70. The actuator mechanism 70 may take a number of forms;

however, the illustrated actuator mechanism 70 acts as a worm and follower actuator. Specifically, the spreader member 40 has a longitudinally extending threaded through hole 74 and a substantially axially extending orienting pin 76. The illustrated orienting pin 76 extends substantially normal to the longitudinal axis of the locking cap 20 and is sized to allow free travel within the interstitial slot 56 while also limiting the free rotation of the spreader member 40 relative to the expansion member 38. The orienting pin 76 may be any suitable member such as, for instance but without limitation, a roll-pin, a dowel pin or a raised surface or flange. Additionally, the material selection is dependent upon strength and corrosion properties as discussed above. In the illustrated embodiment, the orienting pin is a 0.125 inch diameter stainless steel dowel that is press fit into the spreader member 40 about 0.17 inch deep. Other mounting arrangements, of course, are well within the knowledge of those having ordinary skill in the relevant art.

The through hole 74 of the spreader member 40 is sized to accommodate the actuator bolt 28 which has sufficient strength to reduce the likelihood of failure during spreader member motion. The bolt size may range from about #10 to about 0.5 inch, but is about 0.375 inch in the presently preferred embodiment. Additionally, the pitch of the threads may be between about 32 threads per inch and about 13 threads per inch, but the presently preferred pitch is about 16 threads per inch. At this pitch, when combined with the preferred inclination angles, the locking cap 20 may be locked into an opening 24 with about three turns of the actuator bolt 28. It is also anticipated that the locking cap 20 may be locked into an opening with more or less than three turns of the actuator bolt 28.

With continued reference to FIG. 3A, a head portion 78 of the bolt 28 is preferably received in a recess 80 in the face plate 32 while a shank 82 of the bolt 28 preferably extends through the face plate 32, the second hole 62 of the expansion member 38, the threaded through hole 74 of the spreader member 40 and a washer/nut combination 84. Desirably, the washer/nut combination 84 includes a nylon washer 85 to reduce friction between the combination of a stainless steel washer 87 and a lock nut 89 and the back surface 46 of the expansion member 38. Advantageously, the lock nut 89 is configured to intentionally cross-thread onto the bolt 28 and, thereby, become permanently attached to the bolt 28. As will be recognized by those of ordinary skill in the art, an adhesive coating may also be used to reduce the likelihood of any other type of nut 89 working free of the actuator bolt 28.

As introduced above, the expansion member 38 is preferably attached to the faceplate 32. The faceplate 32 may be manufactured from a variety of materials. For instance, the faceplate 32 may be manufactured from hardened polymers, plastics, and a variety of metals. Preferably, the faceplate 32 is manufactured from anodized aluminum, brass, chrome-plated brass or case-hardened steel coated with cadmium. Even more preferably, the faceplate 32 is manufactured from anodized aluminum, brass or a chrome plated brass. In this manner, a variety of surface finishes may be provided to coordinate with color and accent themes of a highly visible public region of a building.

With reference now to FIG. 4, the faceplate 32, in addition to being decorative and capable of receiving various finishes and colors, protects the inner workings of the locking cap 20. The faceplate 32 generally has a front surface 86 and a back surface 88. In some configurations, the faceplate 32 may have an exposed side surface 90 when installed. For instance, the face plate 32 may take on any of a variety of shapes, including, but not limited to, conical, cylindrical, spherical, hemispherical, or any of a number of more complex configurations. In the illustrated embodiment, the faceplate 32 is substantially cylindrical with a chamfered forward edge 92. Importantly, the cylindrical side surface 90 has a short length such that standard tools (i.e., channel locks) may not obtain a sufficient grip on the face plate 32 to turn the locking cap 20 when locked into place. The chamfered edge 92 of the presently preferred face plate 32 allows the exposed thickness. of the face plate 32 to be greater than the cylindrical portion described above. Generally, the exposed thickness varies from about 0.30 inch to about 0.60 inch while in a preferred embodiment, the exposed thickness is about 0.50 inch with only about 0.20 inch of that thickness having a cylindrical sidewall.

The faceplate 32 also has at least one pin 94 that extends forward from the front surface 86 of the faceplate 32. The pin or pins 94 allow gloved personnel to effectively grip the locking cap 20 to remove the locking cap 20 in all weather conditions and during extreme heat such as that encountered due fires. Additionally, where the locking cap 20 has been painted over or corroded, the pins 94 allow a specially designed key handle 96 (see FIG. 3), disclosed in more detail below, to engage the locking cap 20 for breaking the paint or corrosion seal. Specifically, the front surface 86 of the faceplate 32 may have a triangulated pattern of three or more pins 94 to form a gripping surface. More preferably, two pins 94 may span a portion of the front surface 86 diameter.

Advantageously, the pins 94 are also sized and configured to reduce tampering. Specifically, the pins 94 may be intentionally low profile to reduce the likelihood that a standard breaker bar may be placed between them to create leverage for turning the locking cap 20. The pins 94 may also have a tapered tip 98 such that tampering attempts are further thwarted. In the illustrated embodiment, the pins 94 have cylindrical bodies which are press-fit from the back 88 surface of the face plate 32 and which extend between about 0.20 inch to about 0.30 inch above the front surface 86 of the face plate 32. Preferably, the cylindrical portions (i.e., that below the tapered tips 98) extend about 0.16 inch above the front surface 86 of the faceplate 32. The tapered regions 98 of the illustrated pins 94 then extend an additional length which is preferably between about 0.08 inch and about 0.15 inch, more preferably about 0.10 inch.

In one embodiment, a chain stay (not shown) may be attached to the front surface 86 of the faceplate 32 using an acorn nut (not shown) on the threaded fastener 64 that extends through the first hole 60. The chain stay allows the locking cap 20 to be chained to the standpipe 22 or other location such that it is not easily misplaced when removed. As will be recognized by those of skill in the art, the chain stay or chain may also be attached in a variety of other well-known manners.

Figure 5:
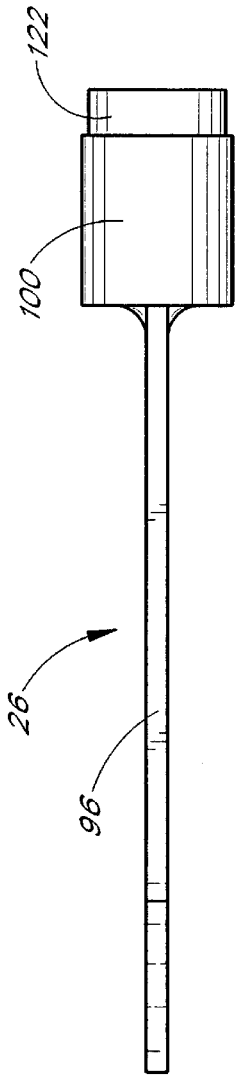
FIG. 5 is a top view of the key of FIG. 3A.
Figure 6:
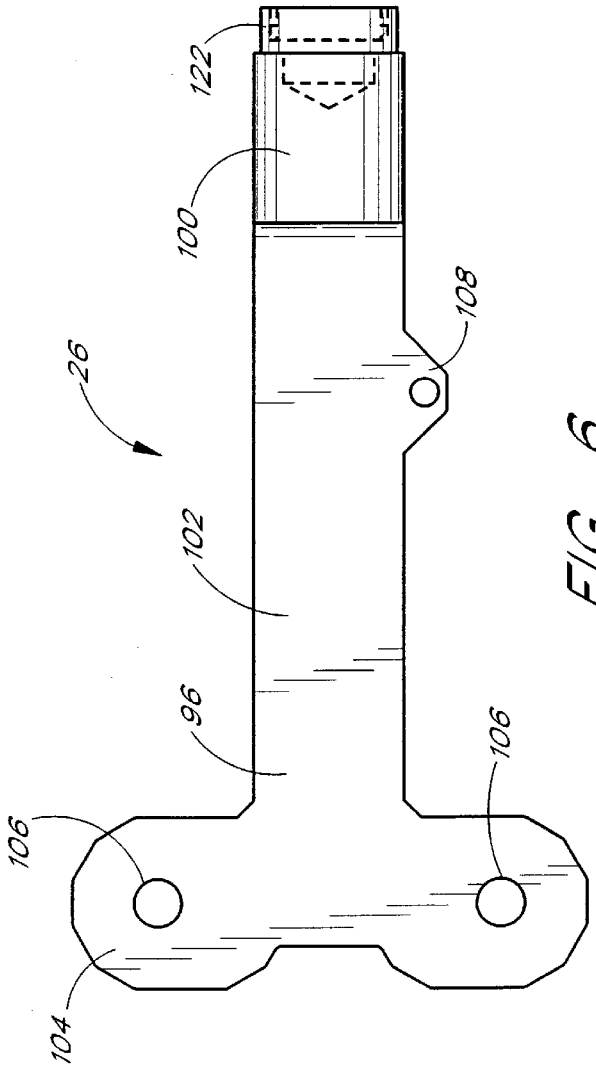
FIG. 6 is a side view of the key of FIG. 3A.

As described above and illustrated in FIG. 5, the locking cap 20 is desirably used with the key 26. With reference now to FIGS. 5 and 6, the key 26 will be described in detail. The key 26 has a key head 100 that extends from the handle portion 96. The handle portion 96 may have various configurations. For instance, the handle portion 96 may be cylindrical, rectangular in cross-section, or any other suitable configuration. The handle portion 96 preferably is shaped in a "T" having a narrow arm portion 102 extending from the key head 100 and terminating in a cross-member portion 104. Additionally, the handle portion 96 is preferably formed from 10-gauge cadmium plated steel. The material selected need only be capable of withstanding sufficient bending moments to allow the tightening of the locking mechanism 36. However, the material may be coated for aesthetic reasons or otherwise treated to achieve the desired material characteristics.

The narrow arm portion 102 preferably has a width that allows the arm to bend when the locking cap 20 is sufficiently tightened into position to reduce the likelihood of over-tightening the locking mechanism 36. For instance, when the key 26 is over-torqued, the narrow arm portion 102 may begin to assume a permanently set spiral bend configuration. By deforming in such a manner, the key 26 provides a mechanism for protecting the locking cap and pipe as well as indicates to the user that the bolt is being over-torqued. For instance, the key may withstand torques between about 40 inch-pounds and about 140 inch-pounds. Preferably, the key may withstand between about 90 inch-pounds and about 125 inch-pounds. Even more preferably, the key may withstand about 100 inch-pounds. The illustrated narrow arm portion 102 has a width of between about 0.75 inch and about 1.0 inch. Preferably, the width is about 0.875 inch.

The cross-member portion 104 preferably accommodates the pins 94 of the faceplate 32. Specifically, the cross-member portion 104 may have sufficient width to allow the cross member portion 104 to span and receive the pins 94 in a set of complementary holes 106. In this manner, the cross-member portion 104 and the balance of the key 26 may act as a breaker if the locking cap 20 cannot be removed by hand. Thus, the key 26 both unlocks the locking cap 20 and allows emergency removal if the locking cap 20 is stuck or jammed in position within the opening 24. Accordingly, the number of tools necessary to remove the locking cap 20 under most operating conditions is reduced to one.

A snapping ring (not shown) may also be attached to the key 26 in any suitable manner. The snapping ring attaching flange 108 is preferably arranged along one side of the narrow arm portion 102 and is more preferably arranged such that the lengths of the key 26 extending on either side of the attachment point are balanced for weight. The snapping ring attaching flange 108 accommodates a snapping ring that allows emergency response teams or service technicians to snap the key 26 onto turn-out gear so the key 26 is less likely to be lost following use.

The key head 100 is sized and configured to engage with the actuator bolt head 78 that forms a part of the actuator mechanism 70. Because the actuator bolt 28 is turned by its head 78, the complementary key head 78 acts as a driver by enabling one to engage the actuator bolt head 78 with the key head 100 (i.e., similar to a lug and socket) and to then turn the actuator bolt 28 with the key 26. As described in detail above, turning the actuator bolt 28 enables one to selectively lock and unlock the locking cap 20. It is understood that a threaded fastener such as the actuator bolt 28 may also be inserted from the other end and, accordingly, the key head 100 would have to interact with a different member (i.e., a nut) to provide the necessary engagement.

Figure 7:
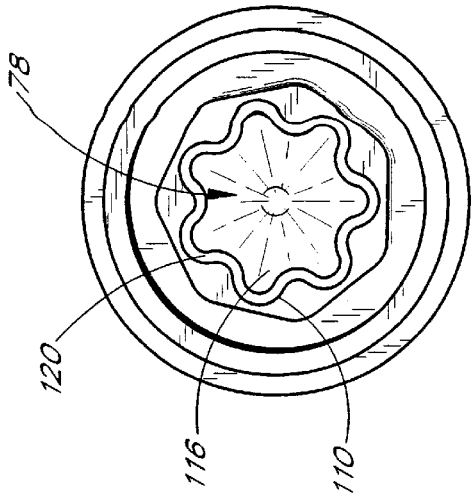
FIG. 7 is an end view of the key of FIG. 3A.
Figure 8:
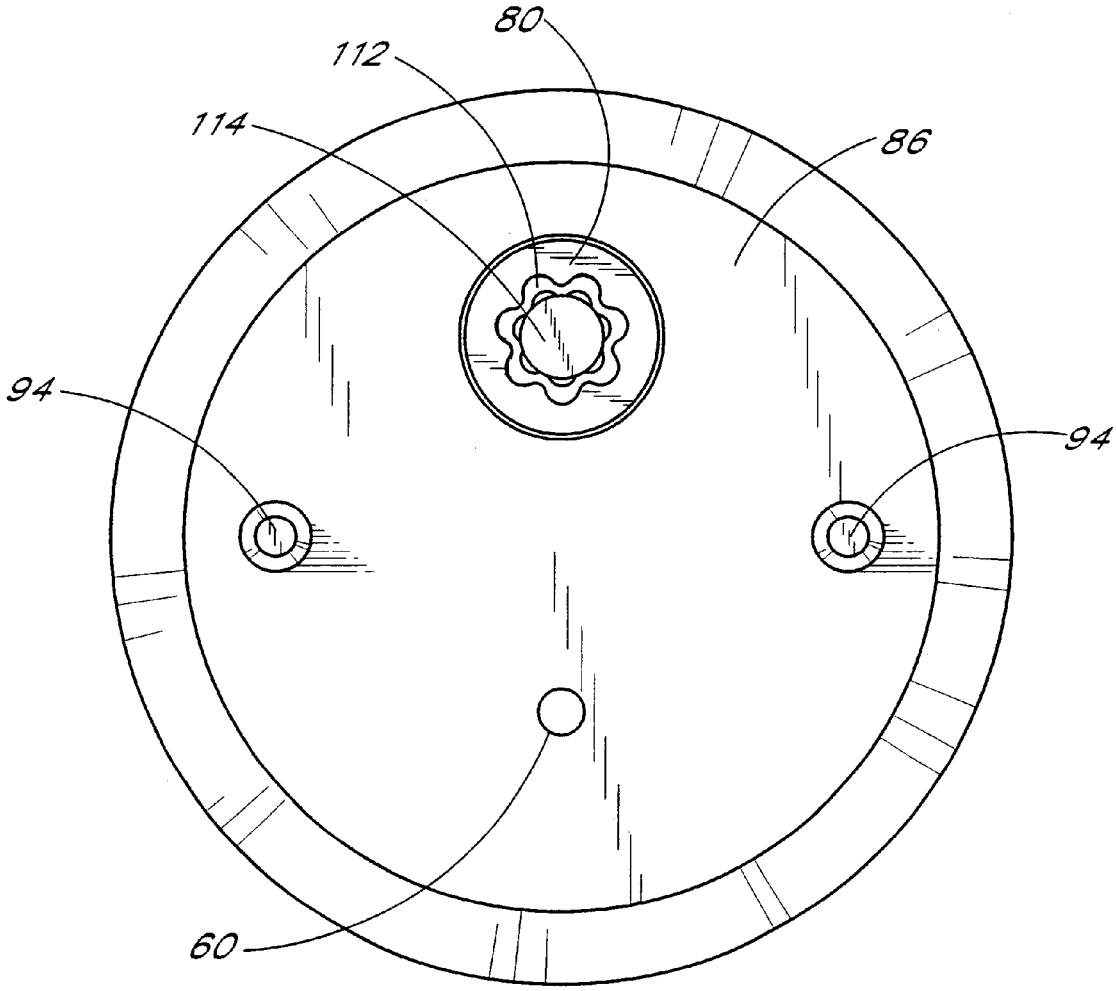
FIG. 8 is a front view of the locking cap of FIG. 3A illustrating the actuator bolt head of the locking cap.

With reference to FIGS. 7 and 8, the key head 100 and the bolt head 78 may be configured with any of a number of engaging structures 110, 112. As is known, one of the two heads may have a male portion 100 and the other head may have a female portion 112, or the key head 100 and the bolt head 78 may have an interlocking hermaphroditic configuration that allows the two to engage without requiring singularly male or female members (i.e., opposing shoulders which extend across half of each). In the illustrated embodiment, the key head 100 has a male pattern 110 while the bolt head 78 has a complementary female pattern 112. Of course, these patterns may also be reversed.

The general pattern used may be any suitable pattern, including an arrangement of various pins and corresponding holes. For instance, a three, four, five or eight-sided pattern may be employed. Because the locking cap 20 is desirably rapidly removed, sometimes by anxious emergency personnel, the pattern is desirably repeating such that the key head 100 will easily engage the bolt head 78 in a variety of orientations. Moreover, a locator pin 114 may be centrally arranged to aid in proper location of the key head on the bolt head. Thus, a recess 116 the key head will seat upon the locator pin 114 for rotation until the patterns 110, 112 drop into engagement. As will be appreciated, the locator pin 114 may also be provided on the key 26 and cooperate with a recess in the bolt head 78.

Due to the unsecured service environments in which the locking cap 20 is likely to be used, a pattern having an odd number of sides is presently preferred. Such patterns appear more difficult to fabricate and reduce the likelihood of tampering by temporary tooling. Thus, the likelihood of unauthorized removal of the locking cap 20 may be decreased by utilizing an odd number of sides. More preferably, the pattern will use a number of non-straight lines. Such lines make the pattern even more difficult to duplicate ad hoc or to otherwise counterfeit. In the illustrated embodiment, one of many seven sided cloverleaf designs is implemented; however, as will be recognized, any of a number of other shapes and configurations is also available. The illustrated cloverleaf features a pattern which repeats about every 50° and, therefore, the key 26 may only need to turnabout 25° in either direction relative to the bolt 28 before engagement occurs between the two members 78, 100.

A bolt head pattern groove 118 is preferably inset within the actuator bolt head 78 to a depth sufficient to allow the key 26 to generate sufficient torque to turn the actuator bolt 28 even if the groove 118 is more than half full of ice, debris or the like. More preferably, the bolt head pattern groove 118 is between about 0.05 inch and about 0.06 inch deep. As will be recognized by those of skill in the art, the bolt head pattern groove 118 may also have a variable depth that is not consistent throughout the pattern groove. For instance, the pattern groove 118 may have alternative peaks and valleys that allow for increased engagement between the key 26 and the actuator bolt 28.

As will be recognized, the head pattern groove 118 also has a groove width. Preferably, the groove width is sufficient to allow a cleaning stylus or pick to travel therein for cleaning and maintenance. Thus, if the pattern groove 118 becomes filled with ice, debris or the like, the pattern groove 118 can be sufficiently cleaned to allow the key 26 to get a bite on the bolt head 78. Preferably, the groove width is between about 0.04 inch and about 0.08 inch. More preferably, the groove width is about 0.055 inch.

With reference to FIG. 7, the key head pattern ridge 120 is advantageously sized and configured to complement the bolt head pattern groove 118. Moreover, the ridge 120 may be press forged from a tool steel blank or otherwise formed by methods well known to those of skill in the art. It is understood that the actual ridge 120 may be formed on an insert that is connected in any suitable manner to the balance of the key 26. Where multiple locking caps are likely to be used, the key head 78 may be formed of a harder material such that the key head pattern 120 is less likely to deform than the bolt head pattern 118. However, in instances where a single locking cap is likely to be found, the bolt head pattern 118 may be formed of a harder material such that the locking mechanism 36 of the sole locking cap is not damaged and the associated single opening 24 rendered inoperable until the locking cap is damaged or destroyed for removal.

With reference to FIGS. 6 and 8, the illustrated key head ridge 120 is protected by a shoulder wall 122. The shoulder wall 120 is preferably sized to encase the tip of the key 26. Thus, if the key 26 is dropped or otherwise impacted, the key head pattern ridge 120 is unlikely to be harmed. The recess 80 within the face plate 32 is preferably sized to accommodate the shoulder wall 122 and may be configured to use the shoulder wall 122 as a guide to direct the key head 78 into alignment with the locking cap locking mechanism 36 (FIG. 2). As will be recognized by those of skill in the art, the shoulder wall height relative to the ridge height may be varied as. desired. Indeed, the shoulder wall may also be eliminated in some locking cap and key configurations.

While one presently preferred embodiment having features, aspects and advantages in accordance with the present invention has been depicted and described in detail, a variety of other locking cap configurations are also envisioned. For instance, an externally threaded pipe opening 24 may receive a locking cap with internal threads. In such a configuration, an expansion member 38 may work from within the pipe opening 24 to pinch the pipe wall between an external cap lip and the expansion member 38. Moreover, a locking finger cam may also be provided which is rotated through use of the actuator bolt 28. For instance, as the actuator bolt 28 turns, the locking finger cam may rotate and effectively expand outward as the cam surface undulates about the axis of rotation. Such outward expansion may allow the locking finger cam to engage an inner pipe surface, an inner thread, or a projection specially designed for such an interconnection.

As will be apparent to those of ordinary skill in the art, various other configurations of locking caps are possible which use the broad concept of a locking cap which is secured to a pipe end using a keyed lock actuator member. Accordingly, although the present invention has been described in terms of a certain preferred embodiment, other embodiments apparent to those of ordinary skill in the art, including embodiments that do not provide all of the benefits, aspects and features set forth herein, are also considered to be within the scope of the present invention. Thus, the scope of the present invention is intended to be defined only by the claims that follow.

What is claimed is:

1. A locking cap for closing an open end of a pipe that has a threaded inner surface, the locking cap comprising a substantially solid and generally cylindrical body having a threaded outer surface which is configured to engage the threaded inner surface of the pipe, the body being elastically deformable between a first diameter in which the body may be inserted into or removed from the open end, and a second diameter in which the body is frictionally locked within the pipe end, a spreader assembly, including a bolt, coupled to the body such that rotation of the bolt causes the body to elastically deform between the first and second diameters, the first diameter being sized such that the body can be inserted or removed from the open end without rotation.

2. The locking cap of claim 1, wherein about three full rotations of the bolt causes the body to elastically deform between the first and second diameters.

3. The locking cap of claim 1 further comprising a longitudinal slot extending through the body transverse to the threaded outer surface, the slot having a length that is greater than one half of an outer diameter of the body and having an outer end that extends through the threaded outer surface.

4. The locking cap of claim 3, wherein the slot extends through an axial center of the body.

5. The locking cap of claim 4, wherein an inner end of the slot terminates in a relief opening.

6. The locking cap of claim 5, wherein the relief opening is arcuate in shape when viewed from a rear surface of the body.

7. A locking cap key for locking and unlocking a locking cap, the key comprising a head and a handle, the head having a generally symmetrical design and a rotational axis being defined through the head, the rotational axis extending through a majority of the handle, the head selectively engageable with a related structure on the locking cap and the handle being configured to plastically deform when a level of torque exceeds a predetermined level of torque.

8. The locking cap key of claim 7, wherein the predetermined level of torque exceeds that required to lock the locking cap in position.

9. The locking cap key of claim 7, wherein the key assumes a permanently set spiral twist as a result of the plastic deformation.

10. The locking cap key of claim 7, wherein the head has a raised pattern disposed on a distal tip of the head.

11. The locking cap key of claim 10, wherein the related structure on the locking cap includes a recessed pattern that is complementary to the raised pattern.

12. The locking cap key of claim 7, wherein the handle includes a hanging ring.

13. The locking cap key of claim 7, wherein the key has a generally T shaped configuration comprising a narrow arm portion and a cross-member, the cross-member having at least one hole disposed therein.

* * * * *